US005607374A

United States Patent [19]

Hesse

[11] Patent Number: 5,607,374

[45] Date of Patent: Mar. 4, 1997

[54] EXERCISE MACHINE

[76] Inventor: Stanley Y. Hesse, 45-135 Namoku St., Kaheohe, Hi. 96744

[21] Appl. No.: 569,756

[22] Filed: Dec. 8, 1995

[51] Int. Cl.[6] ..... A63B 22/00

[52] U.S. Cl. ..... 482/51; 434/255; 601/33

[58] Field of Search ..... 482/70, 51, 52, 482/71, 54, 142, 56; 434/255; 601/23, 27, 33, 34, 35

[56] References Cited

U.S. PATENT DOCUMENTS

| | | | |
|---|---|---|---|
| 2,013,520 | 9/1935 | McDermott | 482/56 |
| 3,363,335 | 1/1968 | Burns et al. | 35/29 |
| 3,460,272 | 8/1969 | Pallicore | 35/29 |
| 3,582,069 | 6/1971 | Flick | 272/79 |
| 4,628,909 | 12/1986 | Tietsworth | 482/51 |
| 4,799,475 | 1/1989 | Iams et al. | 128/25 R |
| 5,224,909 | 7/1993 | Hamilton | 482/70 |
| 5,407,406 | 4/1995 | Canela | 482/51 |

*Primary Examiner*—Stephen R. Crow
*Attorney, Agent, or Firm*—John D. Gugliotta

[57] ABSTRACT

An improved exercise device is disclosed that simulates a crawling motion for the user. A flat, horizontal base is provided, having gripping feet on the underside in order to be placed upon the floor. The base supports at one end a rotatable, torque resistant handlebar which provides a pair of spaced handgrips. The base guides a pair of fully supported shin and knee pads. Each shin and knee pad is designed to distribute the user's weight away from one small pressure point at the knee to the whole length of the user's lower leg, thereby decreasing both the pressure upon and discomfort to the knee. Each shin and knee pad is slidably contained by a pair of non-parallel guide tracks. By guiding the shin and knee pad along a pair of non-parallel tracks, the shin and knee pad is placed at an acute forward angle with the axial center of the base.

8 Claims, 2 Drawing Sheets

EXERCISE MACHINE

BACKGROUND OF THE INVENTION

1. Field of the Invention

The present invention relates generally to exercise equipment and devices and, more particularly, to portable exercise equipment and devices adapted to emulate a horizontal "crawling" action in order to provide a low-impact exercise which will build and tone muscles ranging from the arms, chest, and abdominal to the logs and lower back.

2. Description of the Related Art

As is well known in the art, there are many types and routines of exercise, depending upon which muscles or other body attribute is to be exercised. As is also well known in the art, exercises capable of being performed in a horizontal position puts less stress onto the spine, and gives freedom for movement for users with low back problems, thus strengthening the back gradually. This effect on the back has a substantial rehabilitative benefit for the low back pain sufferer. As a result, there are many types and constructions of exercise equipment which stimulate the user to perform a horizontal "crawling" motion. For instance, U.S. Pat. No. 5,224,909, issued in the name of Hamilton, discloses a mid-body exercise device. And also, in U.S. Pat. No. 3,582,069, issued in the name of Flick, a crawler-type exercising device is disclosed. And also, in U.S. Pat. No. 3,460,272, issued in the name of Pelllicore and disclosing a teaching aid, and again in U.S. Pat. No. 3,363,335, issued in the name of Burhns et al. and disclosing a patterning apparatus, crawling exercisers are further disclosed for a variety of rehabilitative uses.

Although the above cited references all disclose devices to aid a user in exercise training via a "crawling motion", these disclosure suffer a common drawback in their use of parallel sliding tracks for both the arms and legs. By providing a parallel tracking system, the prior art methods place an excessive amount of direct pressure upon the knees, causing a discouraging amount of discomfort or worse.

One known method fails to utilize linear tracking at all to stimulate leg crawling motions, but rather utilizes a twisting motion. As disclosed in U.S. Pat. No. 4,799,475, issued in the name of lams et al., the device permitting a user to simulate crawling motions to improve movement of the truncal muscles and spine suffers from the same problems associated with placing an inordinate amount of pressure upon the user's knees, as well as the additional drawback of concentrating an excessive amount of assertive motion within one area of the lower back, thereby limiting any aerobic benefits and effects.

Consequently, a need has therefore been felt for an improved but less complex mechanism that can be used to stimulate an aerobic workout and for aiding in exercise by simulating a crawling motion without concentrating an excessive amount of weight upon the user's knees.

SUMMARY OF THE INVENTION

It is therefore an object of the present invention to provide an improved exercise device.

It is another object of the present invention to provide an improved exercise device that may be used to simulate a crawling motion.

It is another object of the present invention to provide an improved exercise device that may be used to simulate a crawling motion which further fully supports the user's shins and knees and thereby reducing the amount of stress placed upon the users knees.

It is another object of the present invention to provide an improved exercise device that may be used to simulate a crawling motion which further provides a supporting, stationary hand-grip area in order to provide greater stability for the user.

It is yet another object of the present invention to provide an improved exercise device that can be easily and simply manufactured in order to produce an effective and affordable device for the average consumer.

Briefly described according to the preferred embodiment of the present invention, an improved exercise device is disclosed that simulates a crawling motion for the user. A flat, horizontal base is provided, having gripping feet on the underside in order to be placed upon the floor. The base supports at one end a rotatable, torque resistant handlebar which provides a pair of spaced handgrips. The base guides a pair of fully supported shin and knee pad. Each shin and knee pad is designed to distribute the user's weight away from one small pressure point at the knee to the whole length of the user's lower leg, thereby decreasing both the pressure upon and discomfort to the knee. Each shin and knee pad is slidably contained by a pair of non-parallel guide tracks. By guiding the shin and knee pad along a pair of non-parallel tracks, the shin and knee pad is placed at an acute forward angle with the axial center of the base.

An advantage of the present invention is that the exercise device can be used to simulate a crawling motion.

Another advantage of the present invention is that the exercise device can aid a user in achieving an aerobic workout without stress to the lower back.

Another advantage of the present invention is that it provides lateral torque resistance at the handlebars, thereby providing assertive benefits for the chest and arms.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
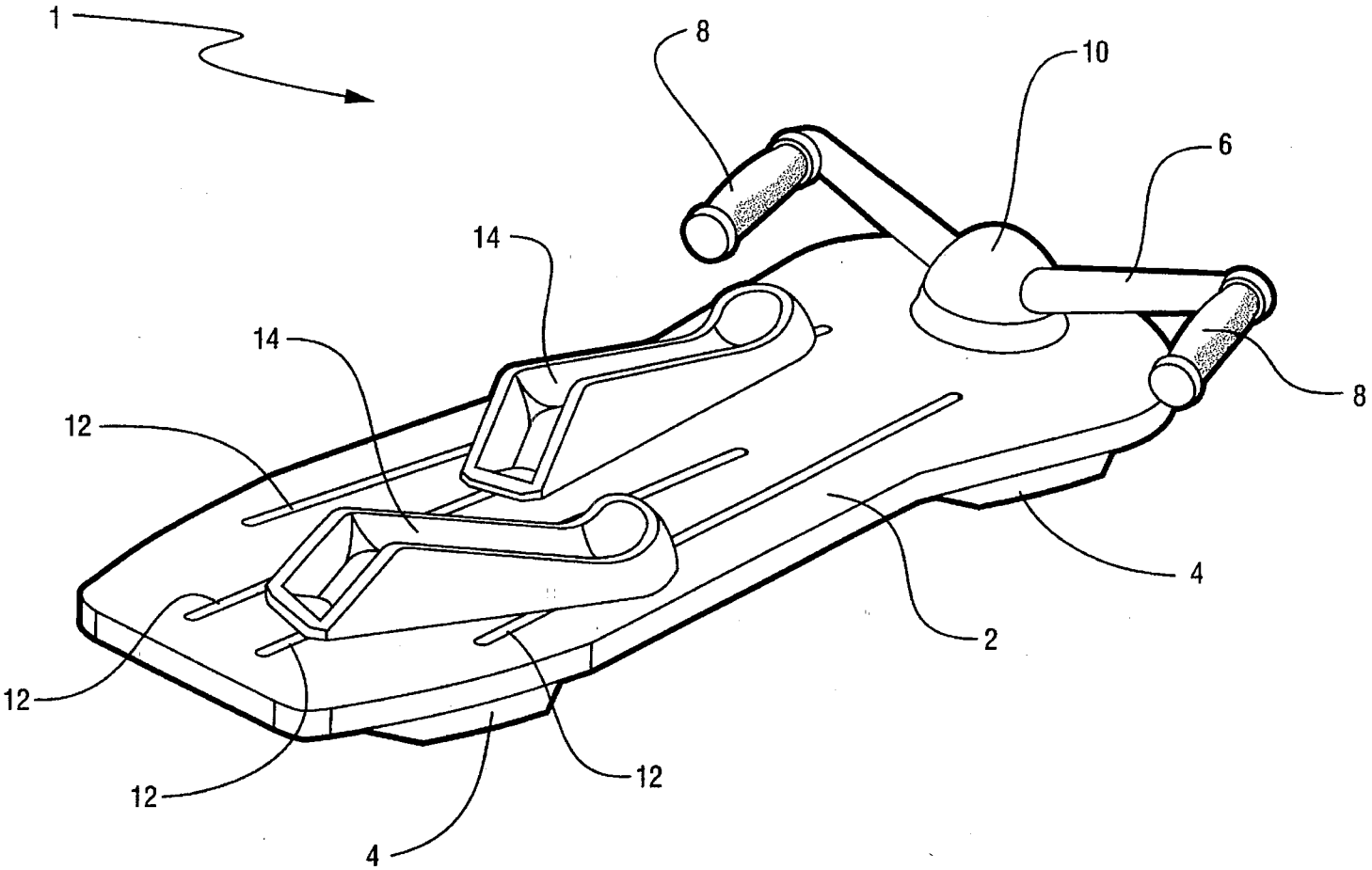
FIG. 1 is an orthographic view of an exercise device according to the preferred embodiment of the present invention.
Figure 2:
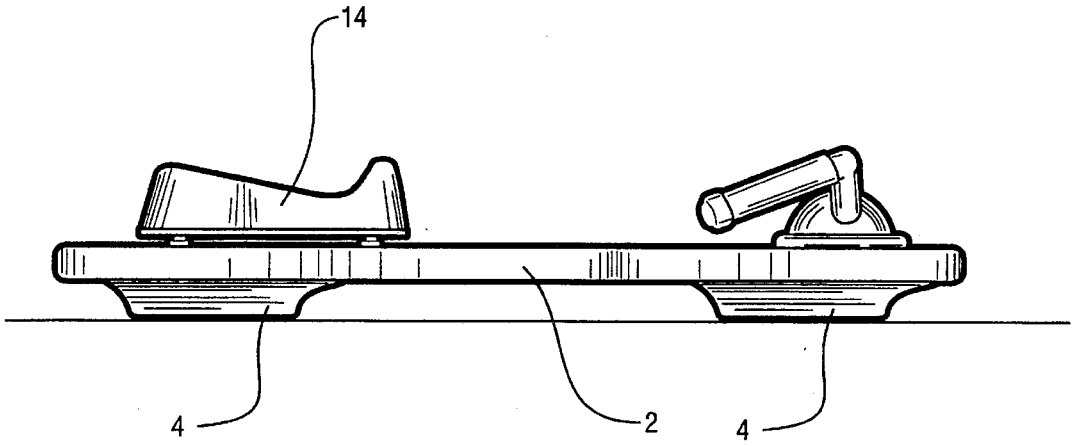
FIG. 2 is a side elevational view thereof.

Referring now to FIG. 1 and FIG. 2, an exercise device 1 is shown, according to the present invention, consisting of a base 2. The base 2 is flat, and horizontally elongated, and is supported on a floor or other flat surface by a plurality of supporting feet 4. The base 2 supports at one end a rotatable, torque resistant handlebar 6 which provides a pair of spaced handgrips 8. In its preferred embodiment it is envisioned that the handlebar 6 is provided with mechanical resistances means at its connection point 10 via a spring, compression, or other conventional means in order provide a torque resistance when pushing or pulling on opposing handgrips 8 in order to provide an aerobic low-impact exercise which will build and tone the muscles of the arms and chest.

Figure 3:
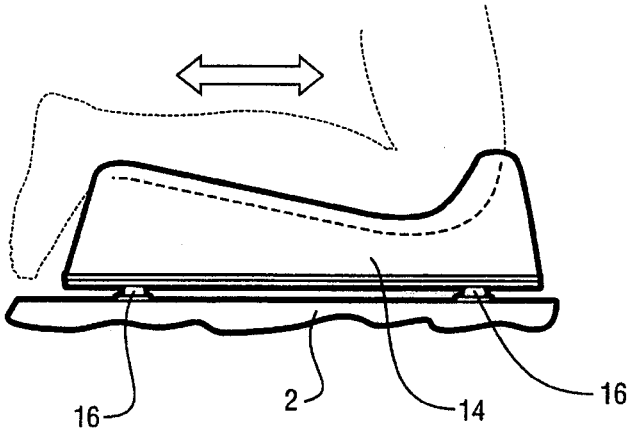
FIG. 3 is a detailed side view of a fully supported shin and knee pad as used with the exercise device according to the preferred embodiment of the present invention.

The base 2 further forms and contains two sets of non-parallel guide track pairs 12. Each set of nonparallel guide track pairs guides and contains a fully supported shin and knee pad 14. As shown in greater detail in FIG. 3, each shin and knee pad 14 is designed to distribute the user's weight away from one small pressure point at the knee to the whole length of the user's lower leg, thereby decreasing both the pressure upon and discomfort to the knee. Each shin and knee pad 14 is slidable contained by the set of non-parallel guide tracks 12, and slides upon a pad sliding means 16 consisting of a roller, a retained post, or other conventional method of containing and sliding a member within a track. By guiding the shin and knee pad 14 along a pair of non-parallel tracks 14, the shin and knee pad 12 is placed at an acute forward angle with the axial center of the base 2.

2. Operation of the Preferred Embodiment

To utilize the present invention, a user simply places his or her hands on the handlebars 6 and knees and shins on the fully supported shin and knee pads 14. The only mechanical resistance proved is within the handlebar 6 which is at rest at the centered position. The shin and knee pads 14 are guided along the guide tracks 12, and are free to move without resistance. A "crawling" action is then achieved by pulling on one side of the handlebar while pulling the knee on that side. By engaging in the opposite motions on the other side, a user achieves a simulated crawling workout.

The foregoing description is included to illustrate the operation of the preferred embodiment and is not meant to limit the scope of the invention. Those skilled in the art will understand that changes can be made in the preferred embodiments here described, and that these embodiments can be used for other purposes. Such changes and uses are within the scope of the invention, which is limited only by the claims which follow.

What is claimed is:

1. An improved exercise device that simulates a crawling motion for the user comprising:

a flat, horizontal base having an upper end and a lower surface, said base further forming and containing a pair of non-parallel guide track sets, each said guide track forming an acute forward angle with the axial center of said base;

a plurality of gripping feet mounted on the lower surface of said base for supporting said base upon and above a floor or similar flat surface;

a handlebar mounted at said upper end of said base, said handlebar having a pair of spaced, padded handgrips; and a pair of fully supported shin and knee pads, each said shin and knee pad designed to distribute the user's weight away from one small pressure point at the knee to the whole length of the user's lower leg, thereby decreasing both the pressure upon and discomfort to the knee, and each said shin and knee pad being slidably contained by a said set of non-parallel guide tracks each said had having a front end aligned with a first track groove and a rear end aligned with a second track groove, whereby a user's legs abduct and adduct during exercise motion.

2. The exercise machine as described in claim 1, wherein said handlebar is mounted in a rotatable, torque resistant manner to said base such that said handlebar provides both mechanical resistance to the pushing or pulling on said handgrips and a returning torque to return said handlebar to a centered, original position.

3. The exercise machine as described in claim 1, further comprising pad sliding means for slidably supporting said shin and knee pad within said set of guide tracks.

4. The exercise machine as described in claim 3, wherein said pad sliding means comprises a retained roller member.

5. In an exercise machine for simulating a crawling motion for a user, said exercise machine having a flat, horizontal base having an upper end and a lower surface, a plurality of gripping feet mounted on the lower surface of said base for supporting said base upon and above a floor or similar flat surface, and a handlebar mounted at said upper end of said base, said handlebar having a pair of spaced, padded handgrips, wherein the improvement comprises:

a pair of non-parallel guide track sets formed by and contained within said base, each said guide track forming an acute forward angle with the axial center of said base; and a pair of fully supported shin and knee pads, each said shin and knee pad designed to distribute the user's weight away from one small pressure point at the knee to the whole length of the user's lower leg, thereby decreasing both the pressure upon and discomfort to the knee, and each said shin and knee pad being slidably contained by a said set of non-parallel guide tracks, each said pad having a front end aligned with a first track groove and a rear end aligned with a second track groove, whereby a user's legs abduct and adduct during exercise motion.

6. In an exercise machine as described in claim 5, wherein the improvement further comprising said handlebar mounted in a rotatable, torque resistant manner to said base such that said handlebar provides both mechanical resistance to the pushing or pulling on said handgrips and a returning torque to return said handlebar to a centered, original position.

7. The exercise machine as described in claim 5, further comprising pad sliding means for slidably supporting said shin and knee pad within said set of guide tracks.

8. The exercise machine as described in claim 7, wherein said pad sliding means comprises a retained roller member.

* * * * *